United States Patent [19]

Scholz et al.

[11] 4,341,513

[45] Jul. 27, 1982

[54] SUBMINIATURE PHOTOFLASH LAMP HAVING LIGHT-EMITTING PYROTECHNIC CHARGE

[75] Inventors: John A. Scholz, Danvers; George J. English, Reading, both of Mass.

[73] Assignee: GTE Products Corporation, Stamford, Conn.

[21] Appl. No.: 146,574

[22] Filed: May 5, 1980

[51] Int. Cl.[3] ..... F21K 5/02

[52] U.S. Cl. ..... 431/362

[58] Field of Search ..... 431/358, 360, 361, 362, 431/364

[56] References Cited

U.S. PATENT DOCUMENTS

| | | | |
|---|---|---|---|
| 1,944,854 | 1/1934 | Van Liempt | 431/362 |
| 2,375,742 | 5/1945 | Kalil et al. | 431/362 |
| 2,913,892 | 11/1959 | Fritz et al. | 431/362 |
| 3,220,224 | 11/1965 | Baird | 431/360 |
| 3,310,968 | 3/1967 | Buzalski | 431/362 |
| 3,332,257 | 7/1967 | Gainer et al. | 431/362 |
| 3,528,354 | 9/1970 | Nakagawa | 431/358 |
| 3,556,699 | 1/1971 | Takahashi | 431/362 |
| 3,685,947 | 8/1972 | Meulemans et al. | 431/362 |
| 3,751,656 | 8/1973 | Buckler | 431/359 |
| 3,972,673 | 8/1976 | Schupp | 431/362 |
| 4,059,388 | 11/1977 | Shaffer | 431/362 |

*Primary Examiner*—Samuel Scott
*Assistant Examiner*—Lee E. Barrett
*Attorney, Agent, or Firm*—Lawrence R. Fraley

[57] ABSTRACT

A subminiature photoflash lamp which includes a pyrotechnic charge centrally disposed within the lamp's plastic, light-transmitting envelope. The charge is supported on the ends of the lamp's ignition means and is of a disklike, planar configuration to provide maximum light output. Ignition of the lamp can be achieved by application of a firing pulse from a piezoelectric element.

13 Claims, 6 Drawing Figures

SUBMINIATURE PHOTOFLASH LAMP HAVING LIGHT-EMITTING PYROTECHNIC CHARGE

DESCRIPTION

TECHNICAL FIELD

The present invention relates to photoflash lamps for use in the field of photography, and particularly to such lamps which are of the subminiature variety and adapted for being electrically activated. Even more particularly, the invention relates to such lamps which utilize pyrotechnic light-emitting charges as the desired light source.

BACKGROUND

The present invention represents a new and unique concept in the production of subminiature photoflash lamps for use in photographic applications. The lamps of the instant invention are adapted for use within multi-lamp devices and articles which in turn may be positioned within or atop a respective camera. Examples of such cameras include those of the well known pocket type variety as manufactured and sold by the Eastman Kodak Company, Rochester, N.Y.

As will be defined, the subminiature photoflash lamp of the instant invention provides for the incorporation of a light-emitting pyrotechnic charge centrally disposed therein. The charge is electrically ignited upon application of a suitable firing pulse across the ignition means (e.g., two electrical wires which extend within the invention) designed for this purpose. Such a pulse can be provided by a power source typically associated with many of today's cameras. One example of such a source is a piezoelectric element. As will be further defined, the invention can be readily produced and operated without the need for many of the components typically found in many of today's flashlamps. Accordingly, the invention can be produced with greater ease and less cost than known lamps of the chemical variety. By the term chemical flashlamp is meant one having a glass envelope, a combustible material such as zirconium or hafnium shreds within the envelope, a combustion-supporting atmosphere (oxygen) also within the envelope, and a pair of lead-in wires which project through the base of the glass envelope and include a quantity of primer material thereon for igniting the shreds.

It is believed therefore that a subminiature photoflash lamp possessing the above several features, as well as those to be defined below, constitutes a significant advancement in the art.

DISCLOSURE OF THE INVENTION

It is a primary object of the present invention to provide a new and unique subminiature photoflash lamp which possesses the features described above.

In accordance with a main aspect of the present invention, there is provided a subminiature photoflash lamp which includes a light-transmitting envelope, a pyrotechnic charge located within the envelope at a preestablished distance from the internal surfaces of the envelope's walls, ignition means for electrically igniting the pyrotechnic charge which includes first and second electrical conductors each having an end portion extending within the envelope for being electrically coupled to the pyrotechnic charge, and support means for maintaining the pyrotechnic charge within the envelope in the defined positioning relationship from the envelope's internal surfaces. Upon ignition, the pyrotechnic charge emits light through the light-transmitting walls of the envelope.

BEST MODE FOR CARRYING OUT THE INVENTION

For a better understanding of the present invention, together with other and further objects, advantages, and capabilities thereof, reference is made to the following disclosure and appended claims in connection with the above-described drawings.

Figure 1:
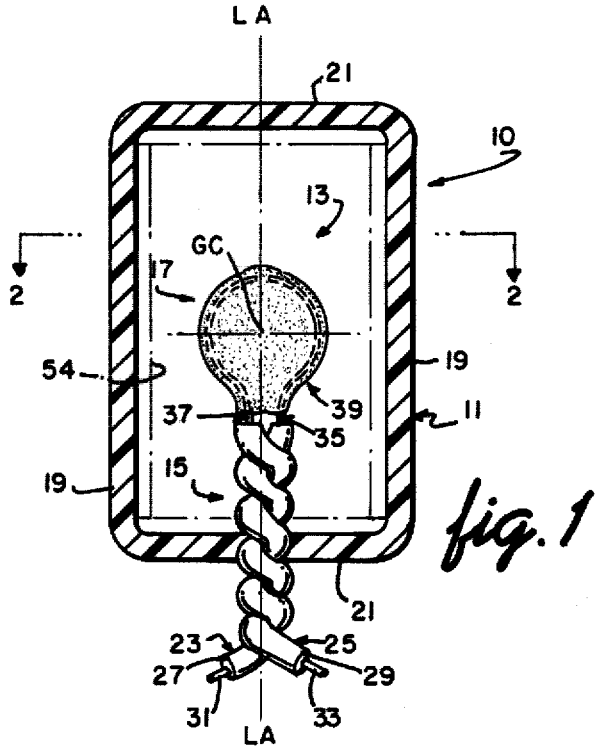
FIG. 1 is a front elevational view, in section, of a subminiature photoflash lamp in accordance with a preferred embodiment of the invention.

With particular reference to FIG. 1, there is shown a subminiature photoflash lamp 10 in accordance with a preferred embodiment of the invention. Lamp 10 comprises a light-transmitting envelope 11, a pyrotechnic charge 13 located within the envelope, an ignition means 15 for providing electrical ignition of charge 13, and a support means 17 for supporting charge 13 at a preestablished distance from any internal surface of the walls of envelope 11. By the term subminiature is meant a photoflash lamp wherein the internal volume of the lamp's envelope is equal to or less than about 0.30 cubic centimeters. Understandably, such lamps are extremely small to thus permit the incorporation of several of these components within a single flash device.

Envelope 11 is preferably of a substantially tubular configuration having, in cross section, opposing longitudinal side walls 19 and opposing end walls 21. Envelope 11 is preferably manufactured from plastic (e.g., polypropylene or polyethylene) tubing having an internal diameter of about 0.33 centimeters and a thickness of about 0.06 centimeters. The internal length of the envelope is approximately 2.00 centimeters.

Ignition means 17 comprises a pair of electrical conductors 23 and 25 which are located within one of the end portions 21 of tubular envelope 11. Both wires are securedly retained within end 21 by a heat sealing process utilized to seal this portion of the envelope. Prior to sealing, it is preferred to twist wires 23 and 25 about each other in the configuration shown such that at least part of the twisted portion will be oriented within the sealed end 21. Understandably, this twisted configuration necessitates utilization of an insulative coating (27 and 29) about the conductive wiring to prevent electrical shorting. The preferred conductive wiring (31 and 33) as utilized in ignition means 15 is of copper material having an external diameter of about 0.025 centimeters. Each conductor includes a first end portion (35 and 37)

which extends within envelope 11 and an opposing end portion which projects externally of the envelope to permit application of a suitable firing pulse thereacross in order to effect ignition of lamp 10. This pulse may be provided by the power sources (e.g., piezoelectric element) typically associated with many of today's cameras.

Figure 5:
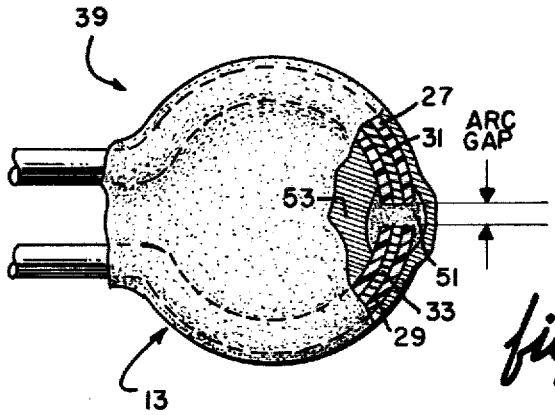
FIG. 5 is another enlarged plan view, partly in section, of one embodiment of the invention's pyrotechnic charge.

The present invention represents a significant advancement over prior art flash lamps which utilize flash-producing charges in that it provides a means whereby the light output of the lamp is substantially increased over said earlier versions. This enhanced light output is provided by strategically positioning the lamp's light-emitting pyrotechnic charge within the envelope at preestablished distances from the internal surfaces of the walls of the envelope such that the burning capacity of the charge material when ignited is maximized. In order to provide this feature, lamp 10 further includes a support means 39 for supporting charge 13 at the desired location. As will be defined, support means 39 may be located on the extending end portions 35 and 37 of ignition means 15 or form a part thereof. In one embodiment of the invention, the support means represents as extension of the conductive wires 31 and 33 from ends 37 and 35 respectively such that the conductive wires form a substantially annular (coil) element (see FIG. 3). It is understood, however, that this support means may also include a separate coil or annular member which is attached to extending ends 35 and 37. Such a coil or annular member could be of electrically conductive (e.g., metallic) material and attached (e.g., soldered) to the ends of wires 31 and 33, or the coil could be of electrically insulative material (e.g., glass) with the extending ends of wires 31 and 33 strategically positioned therein such that the ends are electrically coupled to charge 13. One example of this latter arrangement is illustrated in FIG. 5, to be described below.

Figure 2:
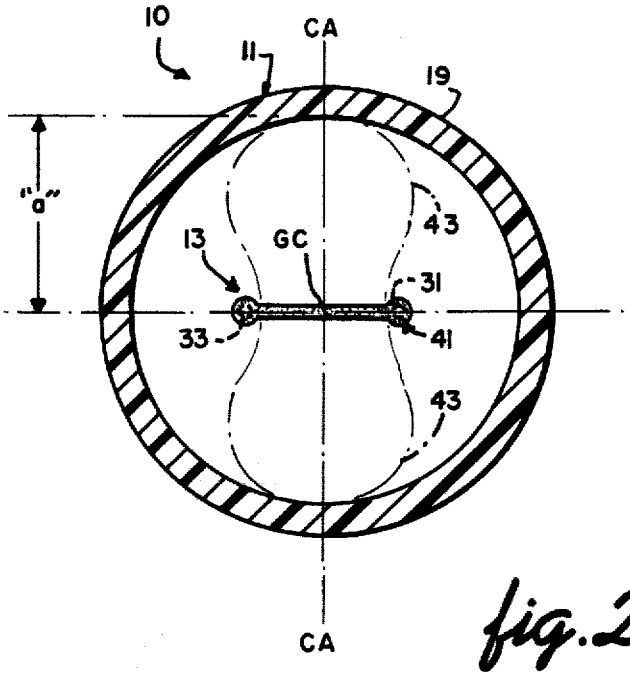
FIG. 2 is an enlarged plan view, in section, of the photoflash lamp of FIG. 1 as taken along the line 2—2 in FIG. 1.
Figure 3:
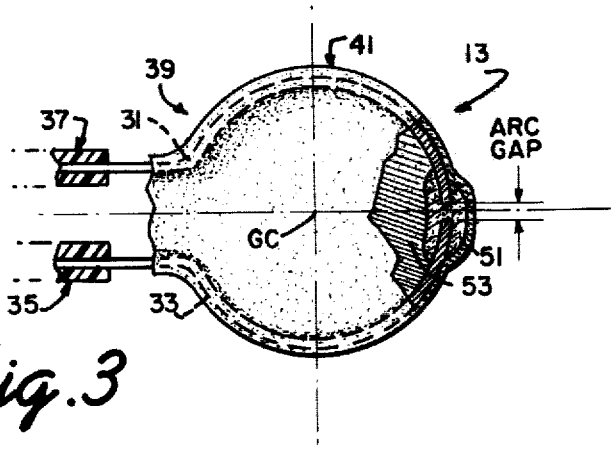
FIG. 3 is an enlarged plan view, partly in section, of one embodiment of the invention's pyrotechnic charge as positioned on the support means of the invention.

With regard to FIGS. 2 and 3, charge 13 is located on the annular support 39 so as to transverse the extending wires 31 and 33, thereby resulting in a substantially disklike, planar configuration. As illustrated in FIG. 2, this disklike member therefore lies substantially between wires 31 and 33 although it is understood that the wires are substantially covered by the charge material. This relationship constitutes a significant feature of the invention in that it permits a minimum of contact between the conductive wires which support the charge and the charge material itself. Accordingly, the wires do not represent a significant heat sink for the material during burning thereof to thereby further assure maximum output from the light-emitting charge. In the arrangement defined, the disklike charge 13 includes a peripheral portion 41 thereabout. The extending ends of wires 31 and 33 which form the preferred support means of the invention thus occupy or contact disklike charge 13 only at this peripheral portion.

As stated, positioning of charge 13 within envelope 11 is deemed critical with regard to the instant invention in order to provide maximization of light output from the charge during ignition thereof. In FIG. 2, the planar disklike charge is centrally disposed within the envelope such that its geometric center (GC) lies on the lamp's central axis (CA-CA). The central axis of lamp 10 is that axis passing through the geometric center thereof and lying substantially perpendicular to the lamp's longitudinal axis LA-LA. It is understood from FIGS. 1–3 that the geometric center GC of charge 13 also lies on the longitudinal axis of lamp 10 and that the plane occupied by this disklike shaped component is also perpendicular to the lamp's central axis CA-CA and thus parallel to the aforementioned longitudinal axis.

As defined, charge 13 is oriented within envelope 11 such that its geometric center is located at the approximate geometric center of the envelope. In this arrangement, the primary burning pattern 43 for charge 13 will be of a substantially bowtie-shaped configuration depicted in FIG. 2. Primary burning of the charge particles within this pattern assures maximum light output when utilizing the planar disklike configuration described. In one embodiment of the invention, charge 13 possessed a thickness of only about 0.03 centimeters and was positioned at a preestablished distance (dimension "a") of about 0.15 centimeters from the internal surfaces of walls 19. As represented in FIG. 2, this dimension from the planar charge 13 is to a tangent passing perpendicular through the central axis CA-CA of the lamp and also parallel to the plane occupied by charge 13. It is understood that the distances between other portions of charge 13 and the internal surfaces of envelope 11 will vary accordingly but at no location will charge 13 physically engage the envelope's internal surfaces.

Ignition of charge 13 is enhanced by providing an arc gap (FIG. 3) within the annular support means 39 and bridging the gap with the charge material. In this arrangement, the application of the aforementioned firing pulse across wires 31 and 33 results in the generation of a spark across the gap and therefore through the charge material to effect ignition thereof. When using the aforedefined copper wiring for wires 31 and 33, the illustrated arc gap is approximately 0.025 centimeters wide. As stated, the support means of the invention may comprise an extension of the invention's electrical conductors. In this regard, it is preferred to utilize a singular wire during the initial stages of manufacture, form the wire into the coil configuration depicted in FIG. 3, remove the insulative material therefrom, and thereafter provide the desired arc gap therein (e.g., by a suitable notching tool). This structure is thereafter covered with the pyrotechnic charge material to provide the configuration shown.

The preferred material for charge 13 comprises a primer composition 51 and a fuel mixture 53 located in physical contact therewith. As illustrated in FIG. 3, the primer composition 51 serves as the bridging member across the support mean's arc gap and is encapsulated (covered) by the second component of the charge material, fuel mixture 53. Primer composition 51 may be selected from any of those currently utilized in the state-of-the-art and adapted for being ignited by pulses typically provided from piezoelectric and similar elements associated with present day cameras. One suitable example is defined in U.S. Pat. No. 4,059,388 (J. Shaffer), which is assigned to the assignee of the instant invention. Approximately 0.50 milligrams of primer 51 is applied across the arc gap and approximately 5.00 milligrams of fuel mixture 53 applied. The preferred fuel mixture is a 57/43 percent mixture of zirconium and potassium perchlorate. The zirconium has a particle size of approximately 11 microns, while that of the perchlorate is 3 microns. Fuel mixture 53 is dispersed in a nitrocellulose-acetone solution, yielding a final percentage of 0.5 percent nitrocellulose in the dried fuel.

The procedure for applying the charge material to the coil support means 39 comprises initially dipping the notched or slotted coil within the primer in slurry form until the primer covers the arc gap in the manner defined. The coil is then removed and the primer composition permitted to dry, afterwhich this structure is immersed within the fuel mixture also in slurry form. This structure is then removed and the fuel permitted to dry. The aforedefined procedure permits the charge material to transverse the coil support in the manner indicated. The resulting charge possesses a light output within the range of about 50 lumen seconds to about 300 lumen seconds over an output period ranging from about 3 to 4 milliseconds (measured at half peak power). An increase in both peak power and pulse duration was possible by insertion of a Teflon liner 54 (shown in phantom in FIG. 1) within envelope 11. This occurred as a result of the liner's increased resistance to charring or discoloration by the burning charge material in comparison to the polypropylene envelope, thus permitting greater light emission for an extended period. It is believed this increased resistance is due to the greater thermal stability of the Teflon. That is, the Teflon possesses a greater resistance to heat without burning, charring, or similarly discoloring. Understandably, liners of other suitable materials could also be used for this purpose.

Figure 4:
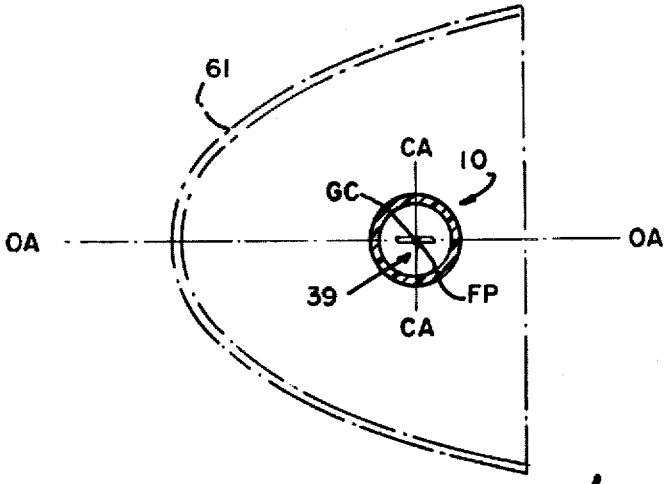
FIG. 4 illustrates the invention as located within a suitable reflector.

With regard to FIG. 4, the preferred positioning relationship between lamp 10 and a reflector 61 (shown in phantom) as might be typically provided within many of today's cameras is shown. In this arrangement, the geometric center GC of fuel charge 39 is located at the focal point FP of reflector 61 while the lamp's central axis CA-CA lies perpendicular to the reflector's optical axis OA-OA. Accordingly, the plane occupied by the disklike charge 39 lies on and parallel to this optical axis. This arrangement assures maximum forward emission of the light generated by charge 39 at lamp ignition. It is understood, however, that lamp 10 could be arranged in various alternative orientations and sufficient output still achieved. For example, it is also possible to arrange the lamp such that the lamp's central axis CA-CA is coaxially aligned with the reflector's optical axis OA-OA.

In FIG. 5, the pyrotechnic charge is oriented on the extending ends of the invention's conductor wires somewhat similarly to the arrangement dipicted in FIG. 3 with the exception that the insulative material (27, 29) which covers the conductive portions (31, 33) of the wires is not removed. This arrangement eliminates the need for such removal, as necessary in FIG. 3, while still assuring an adequate arc gap between the exposed ends of conductive portions 31 and 33. Primer 51 thus bridges conductive portions 31 and 33 and is also in physical contact with fuel mixture 53 to effect ignition thereof.

Figure 6:
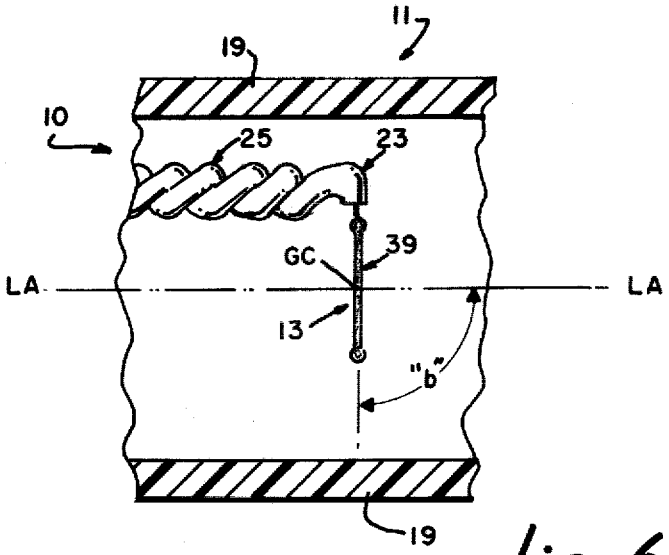
FIG. 6 is a partial elevational view, in section, of one embodiment of the invention's pyrotechnic charge as located within the envelope of the invention.

In the embodiment of FIG. 6, an alternate arrangement of charge 13 within envelope 11 is shown. Specifically, the disklike charge is oriented such that the plane it occupies lies perpendicular (angle "b") to the envelope's longitudinal axis LA-LA and also to the opposing side walls 19. The twisted conductors 23 and 25 are secured within one end 21 (not shown) of envelope 11 in the same manner as described above in FIG. 1.

Thus there has been shown and described a new and unique photoflash lamp adapted for use with many of today's higher speed (e.g., ASA 400) films. The invention as defined provides this output while still assuring miniaturization of the lamp's capsule or envelope member. The invention is also relatively inexpensive to manufacture compared to prior art chemical flashlamps in that it does not require a hermetically-sealed glass envelope, a quantity of shred material within the envelope, or a combustion-supporting atmosphere previously considered essential to such components.

While there have been shown and described what are at present considered the preferred embodiments of the invention, it will be obvious to those skilled in the art that various changes and modifications may be made therein without departing from the scope of the invention as defined by the appended claims.

What is claimed is:

1. A subminiature photoflash lamp comprising:

a light-transmitting envelope;

a pyrotechnic charge located within said envelope at a preestablished distance from the internal surfaces of the walls of said envelope for emitting light through said walls upon ignition thereof, said pyrotechnic charge including a primer composition and a fuel mixture in physical contact with said primer composition;

ignition means for electrically igniting said pyrotechnic charge including first and second electrical conductors secured within said envelope, each of said conductors having an end portion extending within said envelope, said extending end portions electrically coupled to said pyrotechnic charge; and support means for supporting said pyrotechnic charge within said envelope at said prestablished distance from said internal surfaces, said support means located on said extending end portions of said electrical conductors or forming a part thereof, said lamp not including combustible shred material within said light-transmitting envelope.

2. The photoflash lamp according to claim 1 wherein said light-transmitting envelope is plastic and of a substantially tubular configuration.

3. The photoflash lamp according to claim 2 wherein said envelope includes a sealed end portion, said first and second electrical conductors secured within said sealed end portion.

4. The photoflash lamp according to claim 1 wherein said pyrotechnic charge is substantially centrally positioned within said light-transmitting envelope.

5. The photoflash lamp according to claim 1 wherein said support means is electrically conductive and of a substantially annular configuration, said pyrotechnic charge transversing said annular support means.

6. The photoflash lamp according to claim 5 wherein said support means comprises a coil formed by said extending end portions of said electrical conductors.

7. The photoflash lamp according to claim 5 wherein said pyrotechnic charge transversing said annular support means is of a substantially disklike configuration including a round peripheral portion thereabout, said annular support means only contacting said peripheral portion.

8. The photoflash lamp according to claim 5 wherein said annular support means includes a slot therein of sufficient width to define an arc gap, a portion of said pyrotechnic charge bridging said arc gap.

9. The photoflash lamp according to claim 8 wherein said primer composition bridges said arc gap.

10. The photoflash lamp according to claim 1 wherein each of said electrical conductors comprises a metallic wire, each of said wires physically contacting said pyrotechnic charge and including an end portion projecting externally of said envelope.

11. The photoflash lamp according to claim 1 including a liner located within said envelope between the walls of said envelope and said pyrotechnic charge, said liner of a material possessing a greater thermal stability than the material of said envelope.

12. The photoflash lamp according to claim 11 wherein said material of said envelope is selected from the group consisting of polypropylene and polyethylene and said material of said liner is Teflon.

13. The photoflash lamp according to claim 10 wherein each of said metallic wire conductors includes an insulative coating thereon, said wire conductors twisted about each other such that part of said twisted conductors is secured within an end portion of said envelope.

* * * * *